United States Patent [19]

Martin

[11] 4,201,116

[45] May 6, 1980

[54] ELECTRO-HYDRAULIC PROPORTIONAL CONTROL SERVO VALVE

[75] Inventor: Robert J. Martin, Hutchinson, Kans.

[73] Assignee: The Cessna Aircraft Company, Wichita, Kans.

[21] Appl. No.: 814,764

[22] Filed: Jul. 11, 1977

[51] Int. Cl.[2] ..... F15B 13/16

[52] U.S. Cl. ..... 91/387; 91/365; 137/625.64; 251/30; 335/266

[58] Field of Search ..... 91/365, 387, 367; 137/625.64; 251/30; 335/256, 258, 266

[56] References Cited

U.S. PATENT DOCUMENTS

| | | | |
|---|---|---|---|
| 1,236,177 | 8/1917 | Jacobs | 335/256 |
| 2,146,176 | 2/1939 | Donaldson, Jr. | 91/461 |
| 2,507,353 | 5/1950 | Schwendner | 91/387 X |
| 2,767,369 | 10/1956 | Schindler | 323/43.5 R |
| 2,896,588 | 9/1959 | Hayner et al. | 91/387 X |
| 2,966,891 | 1/1961 | Williams | 91/387 |
| 3,003,475 | 10/1961 | Rouvalis | 91/387 |
| 3,099,290 | 7/1963 | Chatham et al. | 251/30 X |
| 3,208,352 | 9/1965 | Lucien | 91/387 X |
| 3,390,613 | 7/1968 | Westbury et al. | 91/363 |
| 3,429,225 | 2/1969 | Keyworth | 91/3 |
| 3,788,194 | 1/1974 | Burns | 91/386 |
| 3,954,045 | 5/1976 | Barlow | 91/387 X |

OTHER PUBLICATIONS

SLI Industries Catalog (1976), p. 3.

*Primary Examiner*—Irwin C. Cohen

[57] ABSTRACT

A conventional control valve hydraulically powered by a double acting cylinder and controlled electrically through a double acting solenoid supplied by a variable D.C. supply. The solenoid transmits varying forces to a four-way pilot valve which in turn controls the positioning of the double acting cylinder. The de-energized solenoid, control valve spool and pilot spool are neutrally balanced between two springs equally loaded with differing spring rates so that a small movement of the solenoid core will cause a proportionally larger movement of the main control valve spool proportioned to the different spring rates.

10 Claims, 3 Drawing Figures

ELECTRO-HYDRAULIC PROPORTIONAL CONTROL SERVO VALVE

BACKGROUND OF THE INVENTION

Solenoid operated directional control valves have long been available; however, they have been the on/-off-type valves which when operated electrically shift to a fully open or fully closed position. In more recent times, electro-hydraulic servo valves have been developed which accurately control the velocity, acceleration, and position of actuators by an electrical signal controlling a hydraulic output. These valves can be used to meter flow to and from hydraulic actuators or to control a variable displacement pump. Servo valves of this nature are either single-stage or double-stage with the latter being prevalent where the pressures and flow rates are significant. In a two-stage valve, the main control spool is actuated by a double acting actuator which is supplied by a pilot valve which is in turn controlled by some form of electro-mechanical transducer such as a solenoid or torque motor. What the pilot stage does is take a low level mechanical signal, amplify it and with the amplified signal control the main control valve spool. A variety of different types of amplifiers in the pilot stage have been used such as spool-type valves; jet-pipe type, single-flapper type and double-flapper type. Also, these types of valves include a feedback function whereby the position of the main control spool provides a signal to the pilot stage so that any error in the main stage can be corrected. This feedback function provides the fine metering and accuracy factor achieved in current generation servo valves.

SUMMARY OF THE INVENTION

The electro-hydraulic servo valve of the present invention utilizes a spool type pilot valve for its amplifying stage which controls a double acting cylinder attached to the main control valve spool with the feedback signal provided by a compression spring positioned between the pilot spool and main control valve spool. The pilot spool is controlled by a small double acting solenoid having a pair of coils capable of actuating the solenoid core in opposite directions which provide a very small actuation stroke to the pilot spool. The pilot spool with the solenoid de-energized is balanced between the feedback spring and a second spring with a substantially higher spring rate than the feedback spring in the neutral spool position. The solenoid rate of force change with respect to position shall always be less than the combined spring rates of the two balancing springs.

Therefore, the principal object of the present invention is to provide a new and improved electro-hydraulic servo valve with a very simplified design which can be powered by a solenoid of minimal size and displacement.

Another object of the present invention is to provide an electro-hydraulic servo valve which can be either single or two-stage which in its two-stage embodiment controls a main four-way or three-way valve.

Another object of the present invention is to provide a pilot system with no wasted neutral flow.

A further object of the present invention is to provide a system where the solenoid coils can be replaced in the field without distrubing the null adjustment of the pilot valve.

These and other important objects and advantages of the present invention are specifically set forth in or will become apparent from the following detailed description of preferred embodiments of the invention, when read in conjunction with the accompanying drawings, wherein.

Figures 1, 2:
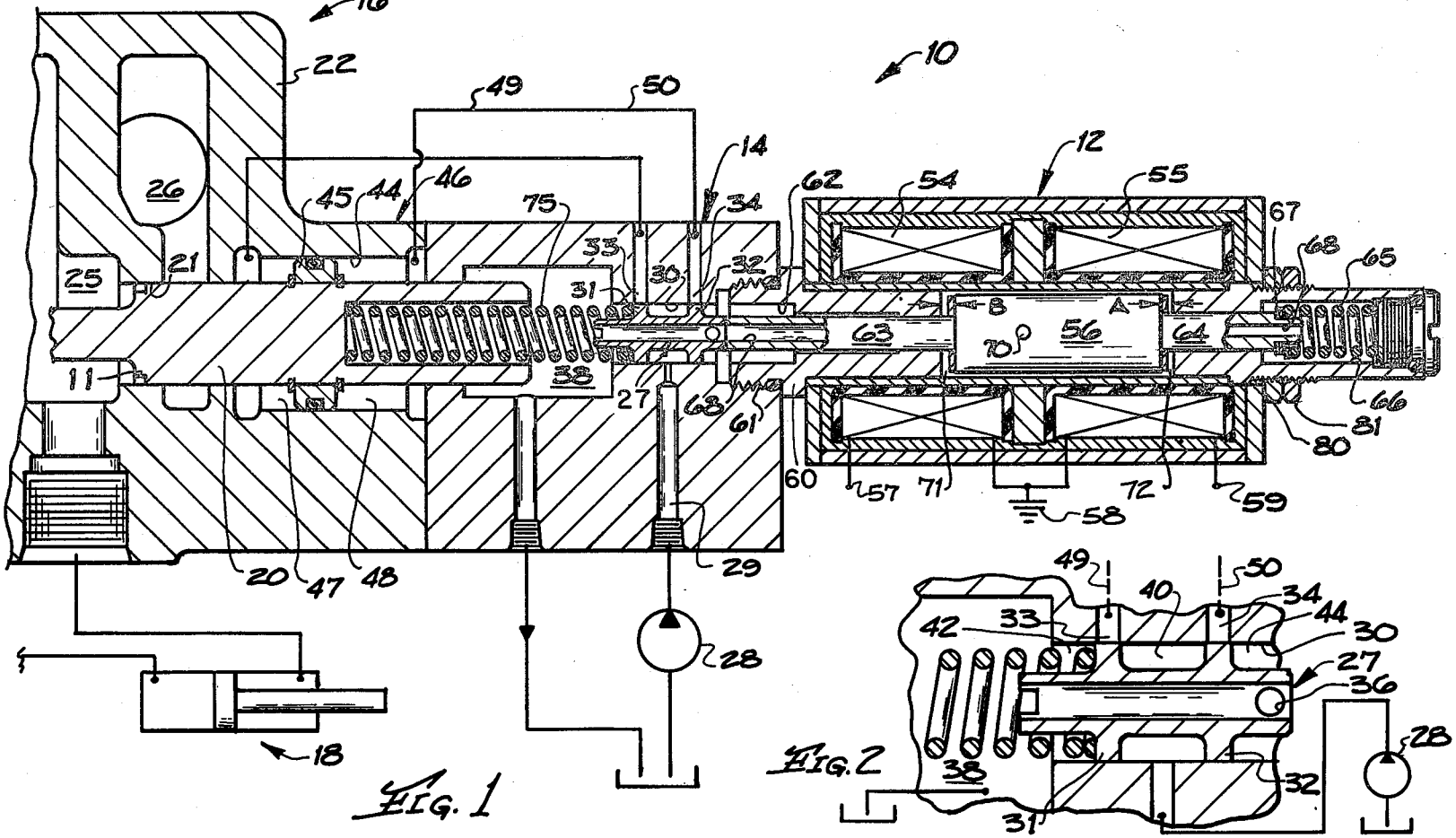
FIG. 1 is a longitudinal sectional view of the servo valve of the present invention with portions of the main control valve broken away.
FIG. 2 is an enlarged sectional view of the pilot spool.

Turning now more particularly to FIG. 1, the electro-hydraulic proportional control servo valve of the present invention is generally described by reference numeral 10. The valve 10 is made up of solenoid unit 12 attached to the hydraulic amplifier section 14 which is attached to the casting of the main directional control valve 16. Main control valve 16 operates a double acting cylinder 18 which could be any type of linear or rotary motor. Control valve 16 which is only partially shown, is a conventional control valve having a valve spool 20 positioned in a bore 21 which in turn is formed in a casting 22. While control valve 16 is a four-way valve, only half of the valve is shown including pump pressure cavity 24, main motor port cavity 25 and drain cavity 26. On the opposite end of spool 20, not shown in the drawing, is a conventional centering spring mechanism which returns valve spool 20 to its neutral position when all actuating forces are removed from the spool. Valve spool 20 is illustrated in its neutral flow blocking position with spool land 23 blocking pump pressure from the motor port 25 while land 11 blocks motor port passage 25 from drain passage 26. While valve 16 is a closed-center type control valve, the present invention would have equal application on open-center type valves.

Low pressure pump 28 supplies pressure to pilot spool 27 via passage 29 into bore 30. Any other pressure source utilized for another function could also be used. Pilot spool 27, which is a closed-center type valve, includes a pair of lands 31 and 32 which in the neutral position block the cylinder port passages 33 and 34. Spool 27 has a longitudinal bore 35 intersected by a lateral hole 36 which connects the areas adjacent both ends of spool 27 with drain cavity 38. The groove area 40 in spool 27 defined by the two lands 31 and 32 is always pressurized with low pressure fluid from pump 28. Groove 41 on the opposite side of land 32 is connected to drain via passages 36, 35 and 38, while the groove 42 on the opposite side of land 33 connects directly to drain passage 38.

Referring to the main control valve 16, spool bore 21 is axially aligned with an enlarged bore 44 which contains a piston 45 slidably positioned therein and attached to spool 20. Piston 45 and bore 44 define a double acting cylinder 46 including two chambers 47 and 48. Chamber 47 is connected with motor port 33 via passage 49, while chamber 48 is connected to motor port 34 via passage 50. Solenoid unit 12 contains a pair of coils 54 and 55 surrounding a single core 56. Power is supplied to coils 54 and 55 through contacts 57, 58 and 59. Positioned on the left end of solenoid core 56 is an attachment fitting 60 which has a threadable end 61 thereon for receipt into the amplifier section 14. While not shown in the drawings, shims can be placed between the flange of fitting 60 and the amplifier section 14 to balance the spool 27. Passing longitudinally through fitting 60 is a bore 62 which receives an extension portion 63 of the solenoid core 56. A similar extension 64 extends from the opposite end of core 56 and is in contact with compression spring 65 located in cavity 66. Shims 67 located on the end of spring 65 can be added or removed to assist in balancing the pilot spool 27 and core 56. Longitudinally passing through the complete length of core 56 and its respective extension portions 63 and 64, is a passage 68 which connects spring cavity 66 with drain cavity 38 allowing oil to flow therethrough. A lateral opening 70 in core 56 allows unpressurized oil to move around the periphery of core 56 including the core displacement cavities 71 and 72. Core 56, as shown in the drawing, is neutrally positioned with its maximum displacement in each direction indicated by dimensions A and B. The package of coils 54 and 55 can be removed from the core 56 by removal of nuts 80 and 81, without affecting the neutral (or null) adjustment of the pilot spool 27. Bearing against the left end of pilot spool 27 is a compression spring 75 which provides the feedback function to the pilot valve. Bearing against the right end of spool 27 is the extension portion 63 of the solenoid core 56 urged by second spring 65. Pilot spool 27 and solenoid core 56 are balanced between the two springs 65 and 75 in their neutral positions when the control valve spool 20 is neutrally positioned. Spring 65 has a spring rate greater than that of feedback spring 75. As for example, spring 65 could have a spring rate 10 times that of spring 75. In other words, for each increment of displacement of spring 75 causing a force change, the change in spring 65 would be 10 times that of spring 75. The rate of force change of solenoid core 56 with respect to the change in core position, is always less than the combined spring rates of springs 75 and 65, so that when solenoid 12 is energized, it will not go to its maximum position.

OPERATION

As shown in FIG. 1, the servo valve unit 10 is shown in its neutral de-energized position. Control valve spool 20 is in its neutral flow blocking position, pilot spool 27 and solenoid core 56 are balanced between springs 75 and 65 in their respective neutral positions. When one of the solenoid cores 54 or 55 is energized, the force balance on pilot spool 27 changes causing a slight movement due to the added force from the solenoid added to one of the springs 75 or 65. If coil 54 is energized, a force to the left is applied to the pilot spool 27 counteracting the force of spring 75. This force imbalance will cause the pilot spool to move to the left compressing spring 75 until the forces are equalized. This leftward movement compresses spring 75 increasing its force, and extends spring 65 decreasing its force. This leftward movement stops at that point when the three forces are again balanced on the pilot spool 27. This slight movement of spool 27 causes land 31 to slightly open motor port 33 to pressure from pump 28 and land 32 to open motor port 34 to drain, thereby causing piston 45 and control valve spool 20 to move to the right opening main motor port cavity 25 to drain 26. Control valve spool 20 will continue to move until pilot spool 27 is returned to its neutral position blocking flow to cylinder 46. As spool 20 moves to the right, spring 75 is compressed, increasing the force on pilot spool 27. When the increases match the added force created by the solenoid 12, pilot spool 27 will return to neutral and control valve spool 20 will stop at a precise position determined by the electrical signal supplied to coil 54.

The movement of the control valve spool 20 is proportional to the rate of spring 75, assuming a constant solenoid force. The movement of the control valve spool is also proportional to the force generated in the solenoid, assuming the spring rate of spring 75 remains constant. If, for example, spring 75 has a spring rate of 20 pounds per inch, spool 20 will move 0.5 inches if a solenoid force of 10 pounds is placed on pilot spool 27.

If the control valve spool 20 requires additional spool travel for added functions such as a float position or a regeneration position, the spring rate of the feedback spring 75 can be decreased. With a decreased spring rate on the feedback spring 75, the valve spool 20 must move a greater distance to build up the same force change. By changing the feedback spring rate, the same controller device which provides the electrical signal to the solenoid (not shown in the drawing) can be used on functions requiring different spool travel.

The greater the electrical signal applied to the solenoid coil, the farther control valve spool 20 opens before it reaches its equilibrium point. With coil 55 energized, with a maximum signal or force, control valve spool 20 would be in its far left position with land 23 providing a maximum opening of pump pressure into motor port 25. In this static condition, pilot spool 27 is neutrally positioned, as shown in the drawing. When coil 54 is de-energized, the force imbalance on pilot spool 27 and core 56 causes pilot spool 27 to shift to the left opening motor port 33 to pump pressure in groove 40, while land 32 opens motor port 34 to drain via 41, 36, 35 and 38. In this dynamic condition, pressure flows from pump 28 into cylinder chamber 47 causing control valve spool 20 to move to the right, thus closing down flow into motor port 25. As spool 20 moves to the right, the balancing force exerted by spring 75 is increasing, due to its compression. When its spring force reaches a certain level, control valve spool 20 will have reached its neutral position and pilot spool 27 will return to its neutral position stopping the movement of control valve spool 20. In this static condition, springs 75 and 65 are balanced with pilot spool 27 in its neutral flow blocking position.

Figure 3:
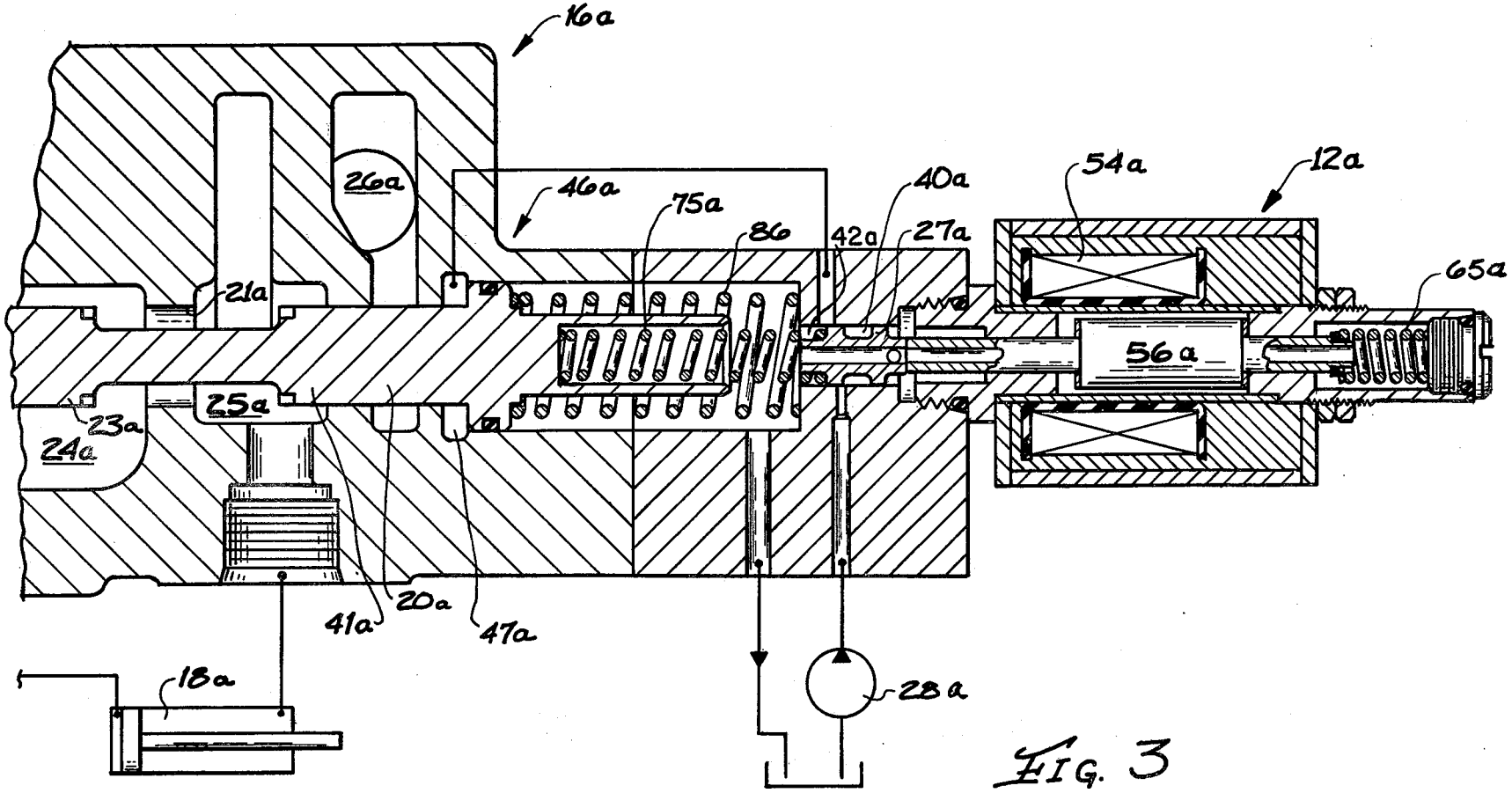
FIG. 3 is a longitudinal sectional view of a modified form of the invention.

In FIG. 3, the main control valve 16*a* is a two-position four-way valve, rather than a three-position valve as shown in FIG. 1. The cylinder 46*a* controlling the valve is single acting rather than double acting, with one chamber 47*a* and a spring 86 which opposes chamber 47*a* and moves the spool 20*a* in the opposite direction when chamber 47*a* is drained. Pilot spool 27*a* is three-way, rather than four-way, having positions blocking flow to chamber 47*a*, applying pressure to chamber 47*a* or draining chamber 47*a*. Solenoid 12*a* has a single coil 54*a* and therefore moves core 56*a* in a leftward direction only. With coil 54*a* de-energized, pilot spool 27*a* will drain chamber 47*a*, via groove 42*a*, regardless of the position of control valve spool 20*a*.

When coil 54*a* is energized with a certain electrical signal, a known force is applied by core 56*a* to the end of spool 27*a* in opposition to spring 75*a*. This solenoid force combined with the force of spring 65*a* is greater than the force of spring 75, thereby causing spool 27*a* to shift to the left sufficiently to open the pump pressure in groove 40*a* into chamber 47*a*. Control valve spool 20*a* will shift from its leftward position in the drawing to the right until the compression of spring 75*a* makes up the force difference caused by the solenoid 12*a*, at which point pilot spool 27*a* will shift to the right to a neutral position blocking flow to or from chamber 47*a*. If the electrical signal is sufficiently strong, main control valve spool 20*a* will move to its far right position fully opening motor port 25*a* to drain port 26*a*. Whenever the solenoid 12*a* is de-energized, spool 20*a* will again shift to its full left position, opening motor port 25*a* to pump pressure cavity 24*a*.

While the drawings illustrate a two-stage electro-hydraulic servo valve, the invention would have utility in a single-stage valve, without the main control valve 20. Pilot spool 27 would be a main control valve and double acting cylinder 46 would be the ultimate motor which is controlled.

Having described the invention with sufficient clarity to enable those familiar with the art to construct and use it, I claim:

1. An electro-hydraulic proportional control servo valve including a valve spool of a conventional directional control valve:

a double acting cylinder connected to the directional control valve spool;

an electro-mechanical transducer means capable of producing varying lineal forces with a varied electrical input signal;

a pressure source and drain;

a four-way pilot valve including a valve spool connected at one end to the transducer means which controls the position of the double acting cylinder, the pilot spool having a neutral position, a first operating position connecting the pressure source with a first chamber of the double acting cylinder while connecting the opposing second chamber of said cylinder to drain and a second operating position connecting the pressure source with the second chamber while draining the first chamber;

a first spring means positioned between the pilot spool and the control valve spool providing a feedback function;

a second spring means having a spring rate greater than the first spring means, acting in opposition to the first spring means, with the pilot spool balanced therebetween, the second spring means is so positioned that when the transducer is not energized, the control valve spool and the pilot spool will return to their neutral positions, and the combined spring rates of the first and second spring means being greater than the rate of force change of the solenoid with respect to solenoid travel.

2. A proportional control servo valve as set forth in claim 1, wherein the double acting cylinder, pilot spool and transducer means are all axially positioned in alignment with the control valve spool.

3. A proportional control servo valve as set forth in claim 1, wherein the transducer means is a double acting solenoid having a pair of coils with a single core capable of actuation in opposite directions, the directional control valve is of a four-way type having a centering spring which urges the control valve spool towards its neutral position.

4. A proportional control servo valve as set forth in claim 1, wherein the transducer means is a double acting solenoid having a pair of coil means with a single core capable of actuation in opposite directions, the coil means being removable without disturbing the core.

5. A proportional control servo valve as set forth in claim 1, wherein the transducer means is a double acting solenoid having a pair of coil means with a single core capable of actuation in opposite directions, the maximum core movement in either direction being less than 0.10 inches.

6. A proportional control servo valve as set forth in claim 1, wherein the four-way pilot valve is a closed-center valve.

7. A single stage electro-hydraulic proportional control servo valve including a double acting cylinder having a piston separating first and second chambers;

an electro-mechanical transducer means capable of producing varying lineal forces with a varied electrical input signal;

a pressure source and drain;

a four-way pilot valve including a valve spool connected at one end to the transducer means which controls the position of the double acting cylinder, the pilot spool having a neutral position, a first operating position connecting the pressure source with a first chamber of the double acting cylinder while connecting the opposing second chamber of said cylinder to drain and a second operating position connecting the pressure source with the second chamber while draining the first chamber;

a first spring means positioned between the pilot spool and the piston of the double acting cylinder providing a feedback function;

a second spring means having a spring rate greater than the first spring means acting in opposition to the first spring means, with the pilot spool balanced therebetween, the second spring means is so positioned that when the solenoid is not energized, the piston of the double acting cylinder and the pilot spool will return to their neutral positions, and the combined spring rates of the first and second spring means being greater than the rate of force change of the solenoid with respect to solenoid travel.

8. An electro-hydraulic proportional control servo valve including a conventional directional control valve and control valve spool;

a double acting cylinder connected to the directional control valve spool having first and second chambers;

a double acting solenoid having a pair of coils capable of actuating the solenoid core in opposite directions;

a pressure fluid source and drain;

a four-way pilot valve including a valve spool connected to one end of the solenoid core which controls the position of said double acting cylinder, the pilot spool having a neutral flow blocking position; a first operating position connecting said pressure source with a first chamber of said double acting cylinder while connecting the opposing second chamber of said cylinder to drain, and a second operating position connecting the pressure source with the second chamber while draining the first chamber;

a first spring means positioned between the pilot spool and the control valve spool providing a feedback function urging the pilot spool toward its first operating position;

a second spring means having a spring rate greater than the first spring means connected to the solenoid core, acting in opposition to the first spring means urging the pilot spool toward its second operating position, the second spring means being so positioned that when the solenoid is not energized and the control valve spool is neutrally positioned, the pilot spool will be neutrally balanced between the two spring means, and the combined spring rates of the first and second spring means being greater than the rate of force change of the solenoid with respect to solenoid travel.

9. A single stage electro-hydraulic proportional control servo valve comprising:

a hydraulic cylinder having a piston and at least one chamber;

an electro-mechanical transducer means capable of producing varying lineal forces with a varied electrical input signal;

a pressure source and drain;

a pilot valve including a valve spool connected at one end to the transducer means which controls the position of the cylinder piston, the pilot spool having a neutral position, a first operating position connecting the pressure source with a chamber of the cylinder, and a second operating position connecting said cylinder chamber to drain;

a first spring means positioned between the pilot spool and the piston of the cylinder providing a feedback function;

a second spring means having a spring rate greater than the first spring means acting in opposition to the first spring means, with the pilot spool balanced therebetween, the second spring means is so positioned that when the solenoid is not energized, the piston of the cylinder and the pilot spool will return to their neutral positions, and the combined spring rates of the first and second spring means being greater than the rate of force change of the solenoid with respect to solenoid travel.

10. An electro-hydraulic proportional control servo valve including a conventional four-way, two position directional control valve and control valve spool;

a single acting cylinder spring biased to the return position connection to the directional control valve spool;

a solenoid having a coil and a core;

a pressure fluid source and drain;

a three-way pilot valve including a valve spool connected to one end of the solenoid core which controls the position of said cylinder, the pilot spool having a neutral flow blocking position; a first operating position connecting said pressure source with said cylinder, and a second operating position connecting said cylinder to drain;

a first spring means position between the pilot spool and the control valve spool providing a feedback function;

a second spring means having a spring rate greater than the first spring means connected to the solenoid core, acting in opposition to the first spring means, the second spring means being so positioned that when the solenoid is not energized the pilot spool will be in its second operating position between the two spring means, and the combined spring rates of the first and second spring means being greater than the rate of force change of the solenoid with respect to solenoid travel.

* * * * *